US005078111A

United States Patent [19]

McCann

[11] Patent Number: 5,078,111

[45] Date of Patent: Jan. 7, 1992

[54] VARIABLE RATIO THROTTLE LINKAGE

[75] Inventor: Harvey D. McCann, Saline, Mich.

[73] Assignee: Ford Motor Company, Dearborn, Mich.

[21] Appl. No.: 695,126

[22] Filed: May 3, 1991

[51] Int. Cl.[5] ..... F02D 9/08

[52] U.S. Cl. ..... 123/400; 123/403; 261/65

[58] Field of Search ..... 123/376, 400, 403; 74/96, 513; 261/65; 251/289, 295, 279

[56] References Cited

U.S. PATENT DOCUMENTS

| | | | |
|---|---|---|---|
| 2,148,729 | 2/1939 | Coffey | 123/342 |
| 2,430,806 | 11/1947 | De Marco | 123/376 |
| 2,430,807 | 11/1947 | De Marco | 123/376 |
| 2,635,595 | 4/1953 | Raleigh | 123/403 |
| 4,117,809 | 10/1978 | Kittler | 123/403 |
| 4,401,078 | 8/1983 | Kato et al. | 123/376 |
| 4,411,845 | 10/1983 | Tanahashi et al. | 123/400 X |
| 4,450,807 | 5/1984 | Kinoshita et al. | 123/403 |
| 4,476,068 | 10/1984 | Griffin et al. | 261/65 |
| 4,502,436 | 3/1985 | Bonfiglioli et al. | 123/339 |
| 4,616,518 | 10/1986 | Nüsser | 123/400 X |
| 4,779,480 | 10/1988 | Stocker | 74/513 |
| 4,782,805 | 11/1988 | Kawano et al. | 123/403 |
| 4,829,961 | 5/1989 | Towner et al. | 123/400 X |
| 4,945,874 | 8/1990 | Nishitani et al. | 123/400 |

*Primary Examiner*—Willis R. Wolfe

*Attorney, Agent, or Firm*—Jerome R. Drouillard; Roger L. May

[57] ABSTRACT

The variable ratio linkage is disclosed for use with a throttle valve having a rotary shaft and comprises a primary lever fixed at one end to the throttle shaft, a secondary lever pivotally attached between its first and second ends to the primary lever, a cable which connects the secondary lever first end to an accelerator pedal, and a throttle return spring for elastically biasing the throttle shaft to a closed position. In the closed position, the secondary lever first end engages a first limit and the secondary lever second end abuts a stop. When the accelerator pedal is depressed, the cable moves the secondary lever first end away from the first limit and causes the primary and secondary levers to rotate relative to one another and slowly rotate the throttle shaft until the secondary lever first end engages a second limit. When this occurs, further movement of the secondary lever first end away from the first limit causes the throttle shaft to rotate at a relatively faster rate.

14 Claims, 8 Drawing Sheets

VARIABLE RATIO THROTTLE LINKAGE

TECHNICAL FIELD

This invention relates to throttle valve control mechanisms, and more particularly to cable operated variable ratio throttle linkage mechanisms for motor vehicles.

BACKGROUND ART

Conventional throttle valve control systems for motor vehicles exist in which the throttle valve opens in direct proportion to the depression of an accelerator pedal. A problem with this design is that often times it is desirable to decrease the sensitivity of the vehicle's accelerator pedal when operating at low speeds, for instance when one is attempting to maneuver in a cramped position. In order to attain some type of non-linear ratio between depression of the accelerator pedal and position of the throttle valve, designers have generally employed complex multi-lever linkages. For example, U.S. Pat. No. 4,782,805 to Kawano and U.S. Pat. No. 4,476,068 to Griffin disclose multiple lever throttling devices in which continued depression of the accelerator pedal results in an increasingly larger incremental opening of the throttle valve. U.S. Pat. No. 4,450,807 to Kinoshita discloses a similar device in which the rate at which the throttle valve opens decreases with pedal travel. A drawback to these designs, however, is that they require a spring on one or more of the ratio-obtaining secondary levers, i.e. those levers that are not directly attached to the throttle shaft, or a bar between the primary and secondary levers, to ensure that the entire linkage returns fully to the idle position. The presence of additional springs or bars on the interconnecting levers often duplicates the effort of a spring attached to the primary lever, but is necessary to reduce any initial free play in the system that otherwise results from slack between the levers. Alternative designs such as U.S. Pat. No. 4,779,480 to Stocker, assigned to the assignee of the present invention, disclose mechanisms which achieve variable ratios through the use of a pivot point of relative rotation between throttle linkage levers which is not fixed. This arrangement, however, also results in the situation where initial depression of the accelerator pedal does not result in instantaneous throttle response.

SUMMARY OF THE INVENTION

The present invention provides a novel variable ratio throttle linkage which has no initial free play because it utilizes a throttle cable return spring in cooperation with an internal or external throttle valve return spring to bias the linkage to a closed position. The variable ratio linkage comprises a primary lever, a secondary lever, a cable, and a throttle return spring. The primary lever has a fixed end for attachment to a throttle shaft, a free end radially spaced therefrom, and a central region. The secondary lever has a first end, a second end, and a pivot therebetween attached to the primary lever and rotatable about a pivot axis. The secondary lever first end cooperates with the primary lever to provide first and second limits for restricting the relative rotation between the first and second levers. The secondary lever second end is adapted to abut a stop for limiting the movement thereof. The cable connects the secondary lever first end to an accelerator pedal. The throttle return spring elastically biases the throttle shaft to the closed position where the secondary lever first end engages the first limit and the secondary lever second end abuts the stop. Initial movement of the secondary lever first end away from the first limit causes the primary and secondary levers to rotate relative to one another and slowly rotate the throttle shaft until the secondary lever first end engages the second limit whereupon further movement of the secondary lever first end away from the first limit causes the throttle shaft to rotate at a relatively faster rate.

Accordingly, it is an object of the present invention to provide a variable ratio throttle linkage of the type described above which has no initial free play.

Another object of the present invention is to provide a variable ratio throttle linkage of the type described above in which the primary lever return force and the cable return force act in the same direction.

Another object of the present invention is to provide a variable ratio throttle linkage of the type described above having primary and secondary levers which rotate relative to one another about a common fixed pivot having no free play.

Another object of the present invention is to provide a variable ratio throttle linkage of the type described above having an adjustable idle stop which allows precise idle speed adjustments to be made.

Still another object of the present invention is to provide a variable ratio throttle linkage of the type described above having an adjustable pedal travel to throttle opening ratio.

These and other objects, features, and advantages of the present invention will be more apparent from the following description and drawings.

BEST MODE FOR CARRYING OUT THE INVENTION

Figure 1:
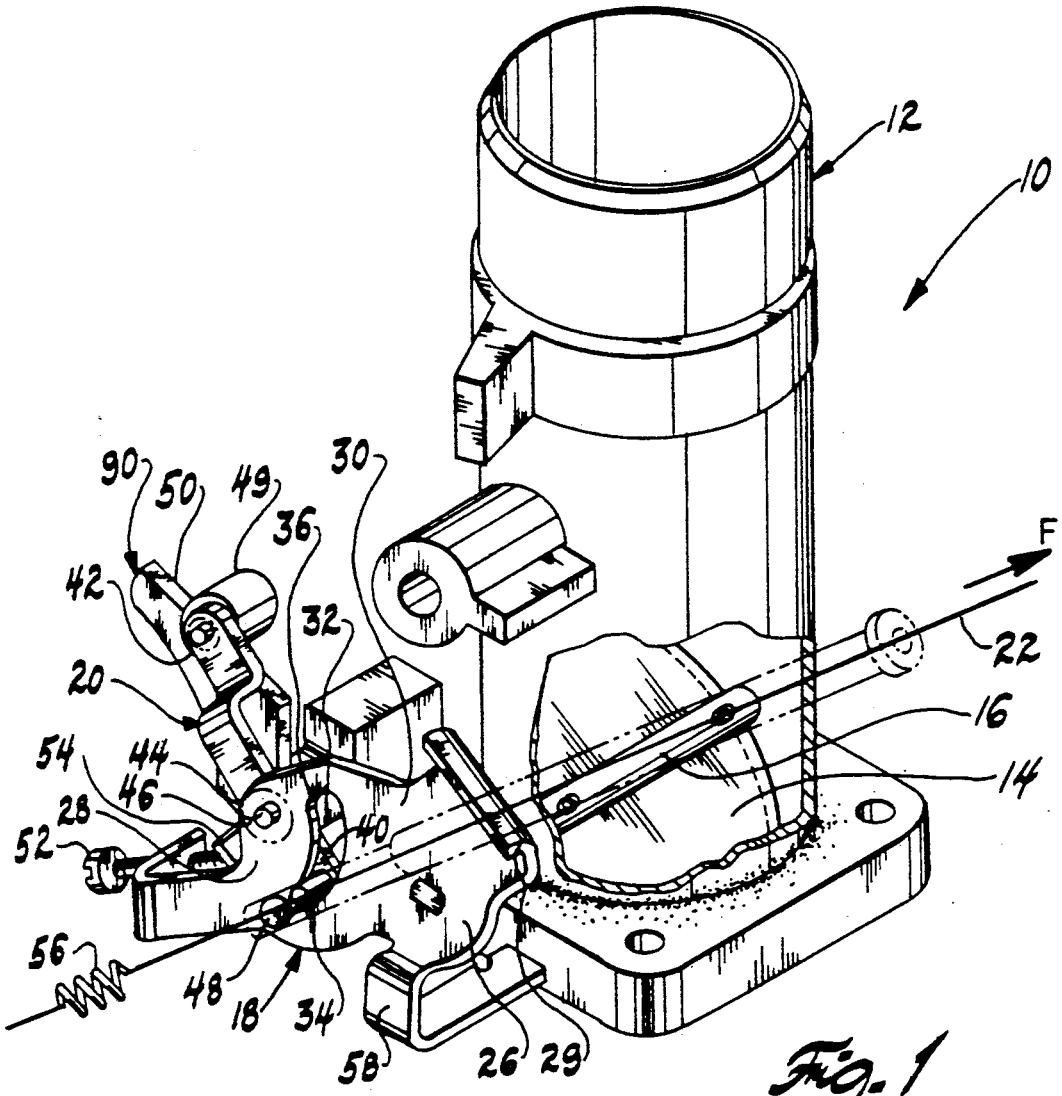
FIG. 1 is a perspective view of a throttle body bore including a variable ratio throttle linkage of the present invention.
Figure 2:
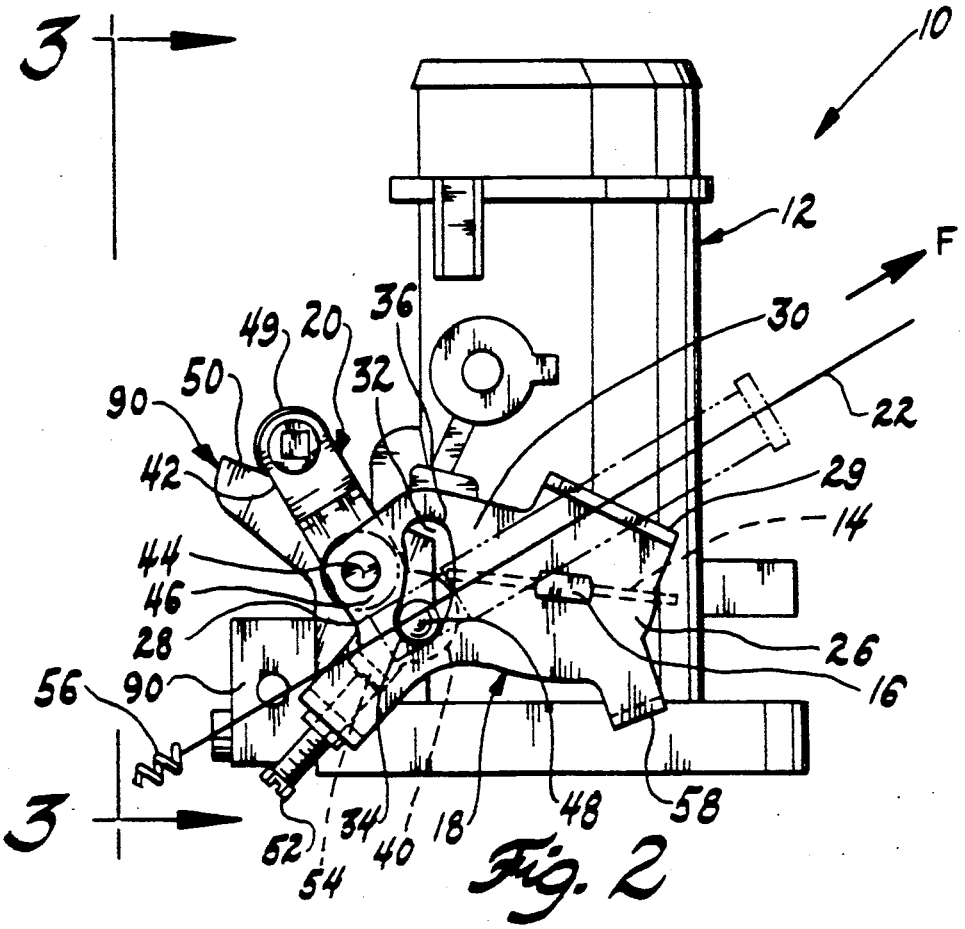
FIG. 2 is a side view of the throttle linkage in an idle position.
Figure 3:
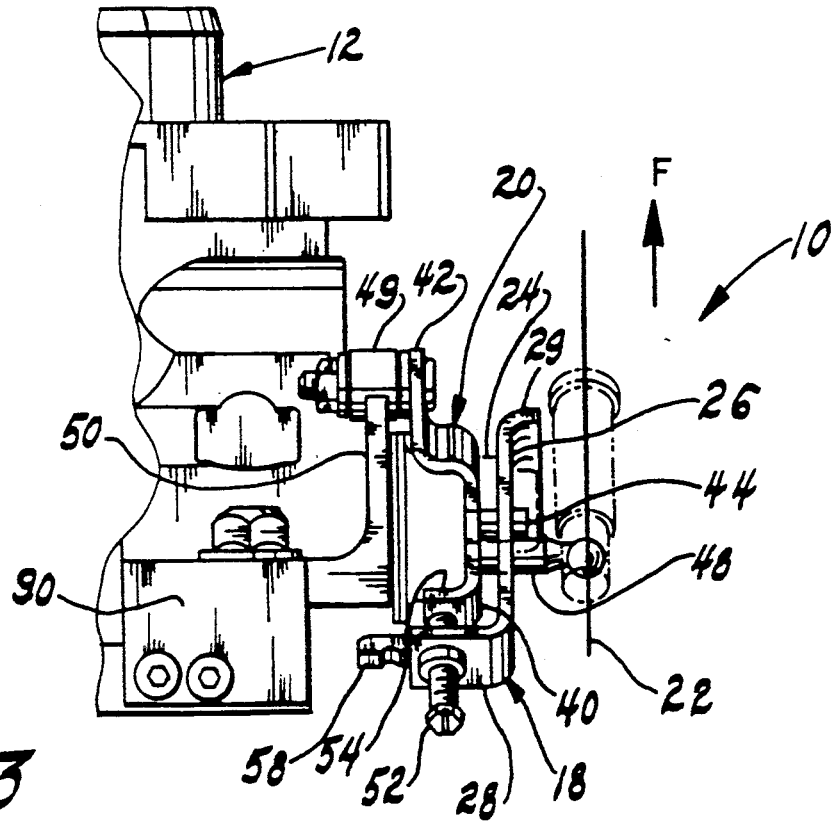
FIG. 3 is a front view of the throttle linkage taken along line 3—3 in FIG. 2.

With reference to the drawings, the preferred embodiments of the present invention will be described. FIGS. 1–3 show a variable ratio throttle linkage assembly 10 which works in cooperation with a throttle body bore 12 having a throttle valve or plate 14 attached to a rotary shaft 16 which is actuated by an accelerator pedal (not shown). The linkage 10 comprises a primary lever 18, a secondary lever 20, a cable 22, and a throttle return spring 24.

The primary lever 18 has a fixed end or gusset 26 attached to the throttle shaft 16, and a free end 28 radially spaced from the throttle shaft 16. The fixed end 26 is bent, for instance at flange 29, to minimize any bending of the primary lever 18 which might occur when the end of the shaft 16 is rotary peened to connect the shaft 16 to the primary lever 18. A central region 30 located between the fixed end 26 and the free end 28 of the primary lever 18 is formed with an arcuate slot 32 which includes opposite first and second ends 34 and 36. The first and second ends 34 and 36 of the arcuate slot 32 comprise first and second limits, respectively, for restricting the relative rotation between the primary lever 18 and the secondary lever 20, as described below.

The secondary lever 20 has a first end 40 and a second end 42, and an integral pivot pin 44 therebetween. The pivot pin 44 projects away from the secondary lever 20 and through the free end 28 of the primary lever 18, and is secured thereto by a retainer clip 46. The pin 44 defines a pivot axis generally parallel to the throttle shaft 16. The secondary lever first end 40 includes a cable attachment pin 48 which projects into the slot 32 and to which the cable 22 is attached. The secondary lever second end 42 includes a roller 49 which abuts a stop or cam face 50 to limit the movement of the secondary lever second end 42.

An adjustable idle stop such as idle speed screw 52 is threadingly engaged with the primary lever 18, and abuts a projection 54 on the secondary lever 20. When the idle speed screw 52 abuts the secondary lever projection 54, and the roller 49 of the secondary lever second end 42 abuts the stop 50, the throttle shaft 16 is in a closed or idle position shown in FIG. 2. The idle speed screw 52 can be adjusted to restrict the relative rotation between the levers 18 and 20 to enable the closed position of the throttle shaft 16 to be varied. Generally, this adjustment is factory preset. This idle set on the primary lever allows the linkage to repeatedly return to precisely the same idle speed, while avoiding the introduction of transmission slop. Thus, normal transmission slop/idle speed repeatability trade-off is eliminated.

The throttle return spring 24 may be torsional coil type or cylindrical helical type, and is preferably wound around the throttle shaft 16 outside of the throttle body bore 12. Alternatively, the throttle return spring 24 can be arranged in any conventional manner such that it directly engages the primary lever 18 and elastically biases the primary lever 18, and thus the throttle shaft 16, to the closed position.

The cable 22, and thus the entire throttle linkage 10, is also biased toward the closed position by a cable return spring 56. Because the cable return spring 56 acts in the same direction as the throttle return spring 24, the pivot point 44 between the levers 18 and 20 is preloaded in the no-slop direction, while idle speed repeatability is still maintained.

Figure 4:
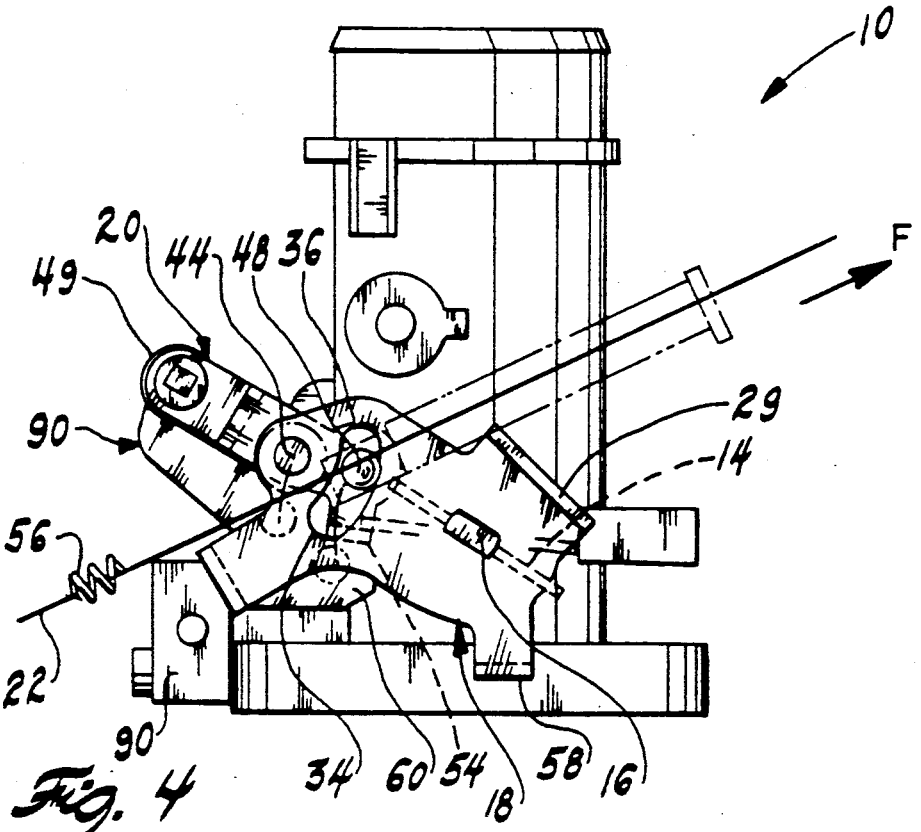
FIG. 4 is a side view of the throttle linkage in a low speed throttle position.

As shown in FIG. 4, initial depression of the accelerator pedal draws the cable 22 in the direction of force arrow F. The cable attachment pin 48 on the secondary lever first end 40 moves away from the first limit defined by the first end 34 of the slot 32, drawing pivot pin 44 in an arc and moving roller 49 slightly outwardly along the stop 50. Thus, the primary lever 18 and the secondary lever 20 rotate relative to one another about the pivot pin 44 and slowly rotate the throttle shaft 16. The low speed throttle range over which this relatively low throttle opening to pedal travel relationship is produced is dependent on the arcuate distance between the ends 34 and 36 of the slot 32. While the cable attachment pin 48 is free to move within the arcuate slot 32, each incremental distance of travel y of the cable 22 results in a relatively small rotation $\theta$ of the throttle shaft 16 according to the following formula:

$$\tan\theta = \frac{(yL_3)/(L_2 + L_3)}{(L_1 + L_2)}$$

where $L_1$ refers to the distance between the throttle shaft 16 and the cable attachment pin 48, $L_2$ refers to the distance from the cable attachment pin 48 to the pivot pin 44, and $L_3$ refers to the distance from pivot pin 44 to the roller 49. In a preferred embodiment, the throttle shaft 16 initially opens about 14° per inch of travel of the cable 22.

Figure 5:
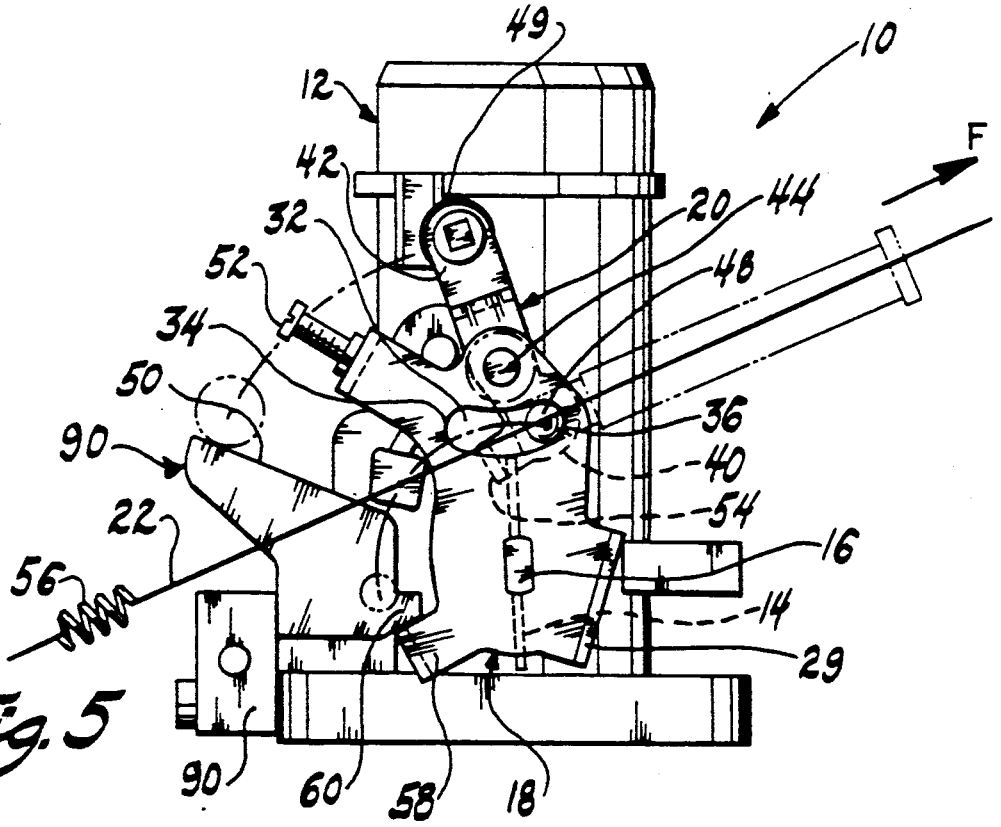
FIG. 5 is a side view of the throttle linkage in a high speed throttle position.

When the cable attachment pin 48 engages the second end 36 of the slot 32, no further relative rotation of the primary and secondary levers 18 and 20 is possible. As shown in FIG. 5, the secondary lever 20 has pivoted about the pivot pin 44, and the roller 49 on the secondary lever second end 42 no longer abuts the stop 50. As the cable 22 is pulled further in the direction of force arrow F, the throttle shaft 16 rotates at a relatively faster rate, i.e. in direct proportion to displacement of the cable 22 because the throttle shaft 16 is affixed to the primary lever 18. At this point, the throttle valve 14 opens in a high speed relation to depression of the accelerator pedal according to the formula:

$$\tan\theta = \frac{y}{L_1}$$

or about 45° per inch of cable travel in a preferred embodiment. At wide open throttle, arm 58 on the primary lever 18 abuts a stop 60 to prevent the throttle valve 14 from pivoting past the vertical.

Figure 6:
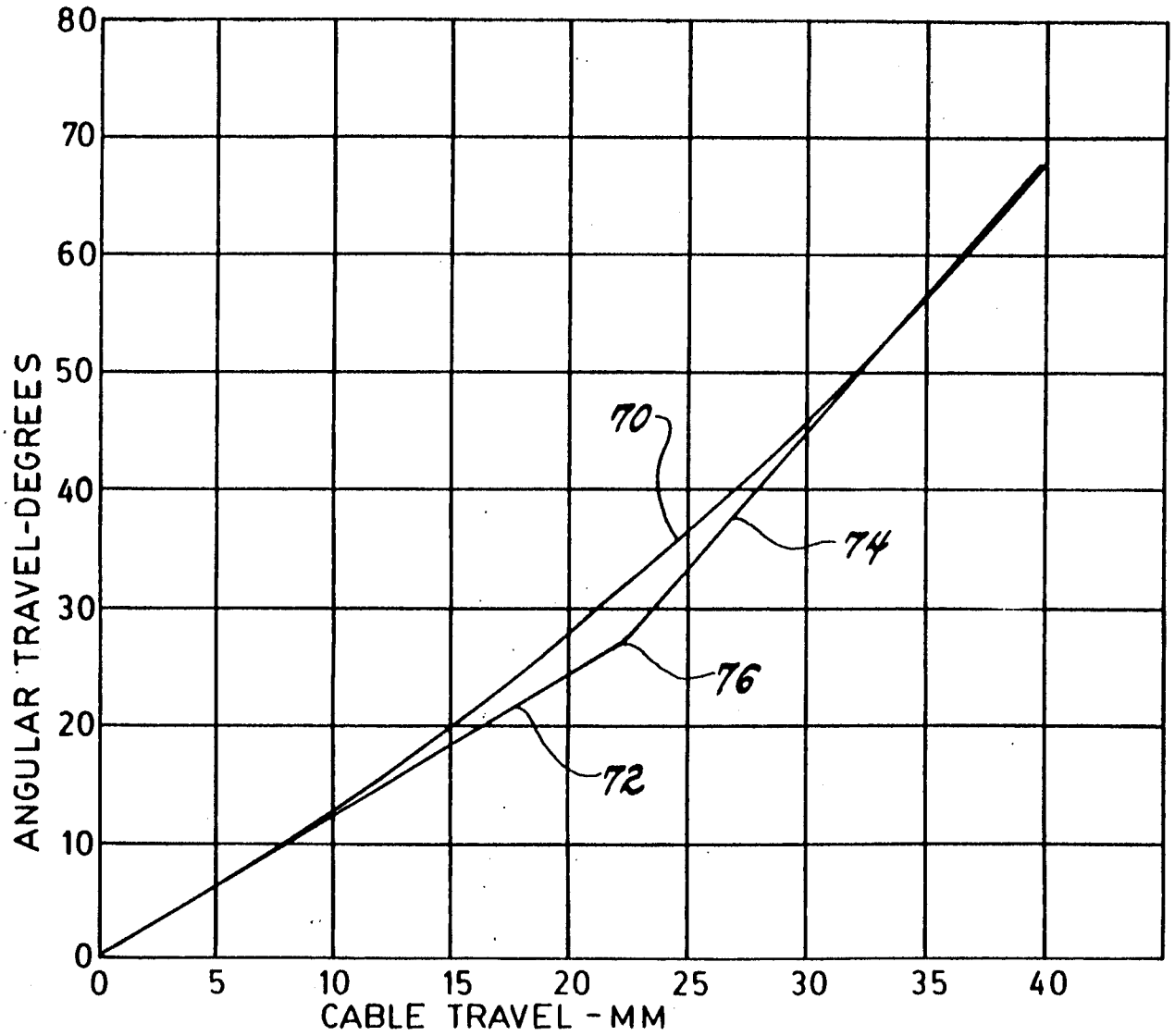
FIG. 6 is a graph illustrating the relationship between cable travel and angular travel of the throttle valve.

FIG. 6 shows a comparison of the performance obtained from conventional linkages with that obtained from the present invention. The relationship between cable travel and angular travel of the throttle shaft for conventional throttle linkages is depicted by the curve 70. In contrast, the curve produced by the present invention has a low speed portion 72 characterized by a relatively small slope during the initial 20–25 millimeters of cable travel, and a high speed portion 74 characterized by a larger slope. At point 76, corresponding to the event of the cable attachment pin 48 engaging the second end 36 in the slot 32, the sensitivity of the throttle valve 14 to further travel of the cable 22 is increased.

Figure 7:
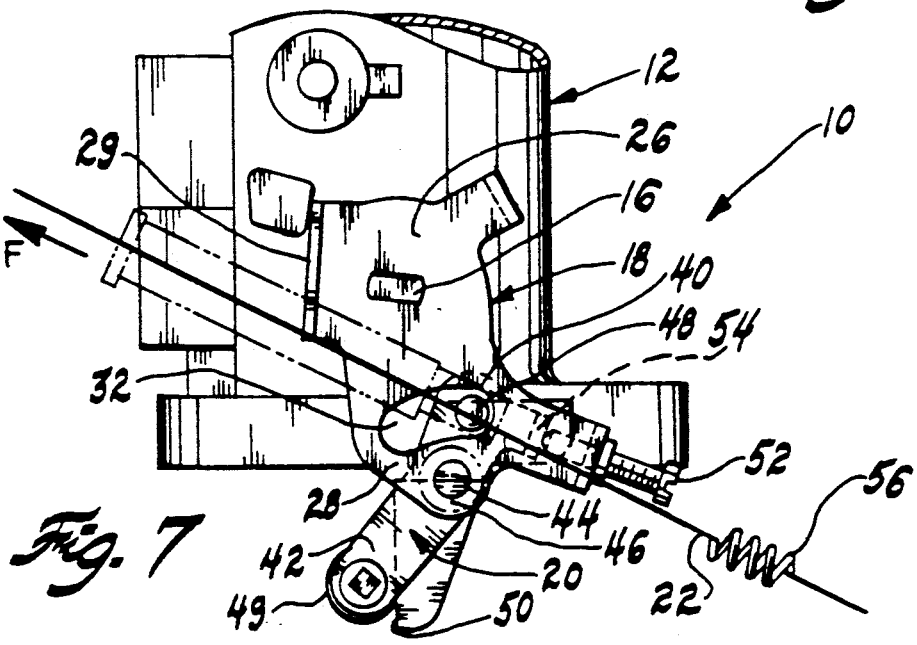
FIG. 7 is a side view of the throttle linkage in an alternative orientation.

FIG. 7 shows that the orientation of the present invention can be changed without affecting its operability. Thus, for a design in which the cable 22 is pulled in the direction of force arrow F, the primary lever 18 is connected to the throttle shaft 16 at a slightly different angle than that shown in FIGS. 1-5. The levers 18 and 20 rotate relative to each other in the same manner, however, with the stop 50 and other parts arranged accordingly in a fashion one skilled in the art can appreciate.

Figure 9:
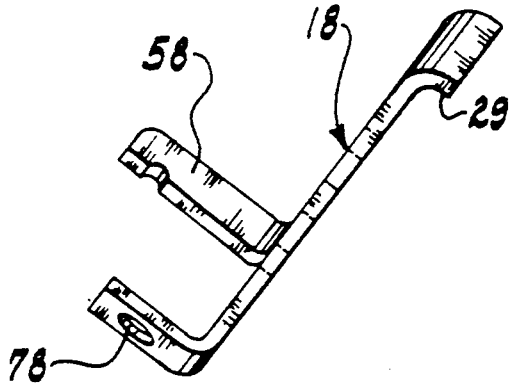
FIG. 9 is a perspective view of the primary lever.
Figure 10:
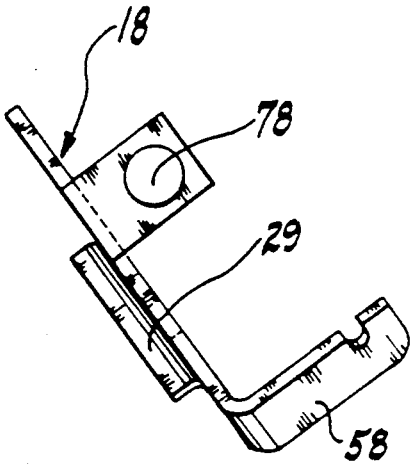
FIG. 10 is another perspective view of the primary lever.
Figure 8:
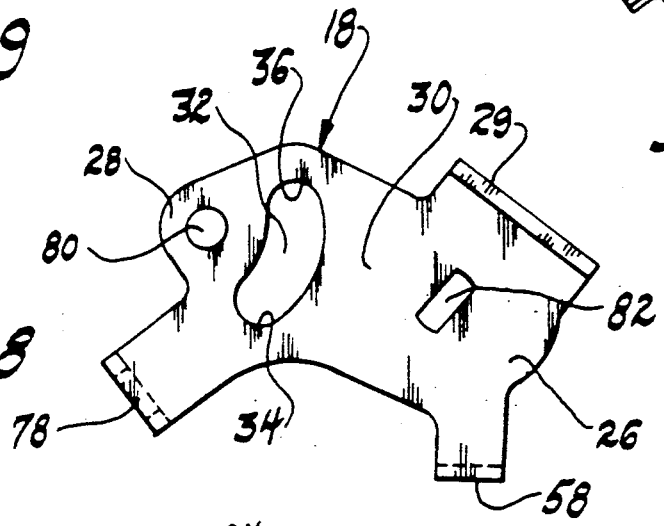
FIG. 8 is a side view of a primary lever for use with the throttle linkage shown in FIG. 1.

FIGS. 8-10 show the primary lever 18. As noted above, the wide open throttle stop arm 58 prevents the primary lever 18 from rotating past wide-open throttle. A hole 78 is adapted to accept the idle speed adjust screw 52, and holes 80 and 82 accept the pivot pin 44 and the end of the throttle shaft 16, respectively.

Figure 11:
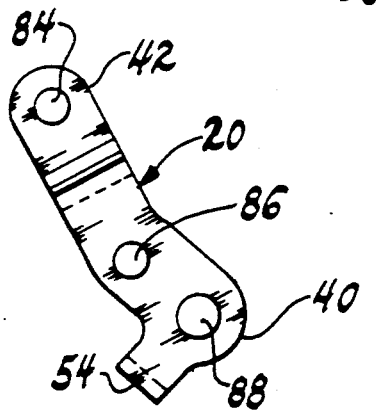
FIG. 11 is a side view of a secondary lever for use with the throttle linkage shown in FIG. 1.
Figure 12:
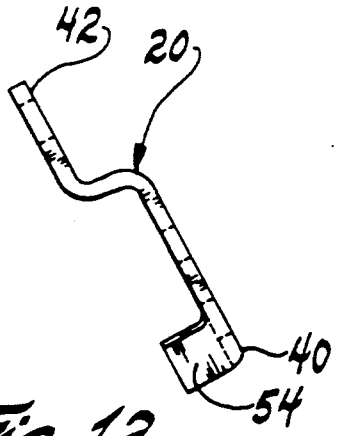
FIG. 12 is a front view of the secondary lever.

FIGS. 11 and 12 show the secondary lever 20. As noted, the projection 54 on the secondary lever first end 40 is the point at which the screw 52 abuts the secondary lever 20. Holes 84, 86 and 88 are respectively adapted to receive the end of the roller 49, the pivot pin 44, and the cable attachment pin 48.

Figure 13:
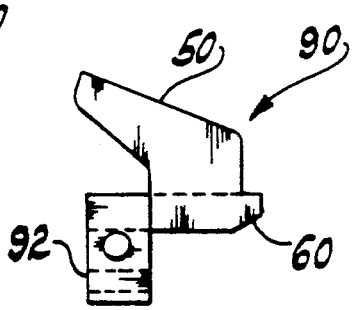
FIG. 13 is a side view of a bracket for use with the throttle linkage shown in FIG. 1.

FIG. 13 shows a bracket 90 having the cam face or stop 50. The wide open throttle stop 60 is the face against which the arm 58 on the primary lever 18 abuts to prevent rotation of the throttle shaft 16 past wide open throttle. An extension 92 is provided through which a bolt can connect the bracket 90 to the base of the throttle bore body 12.

Figure 14:
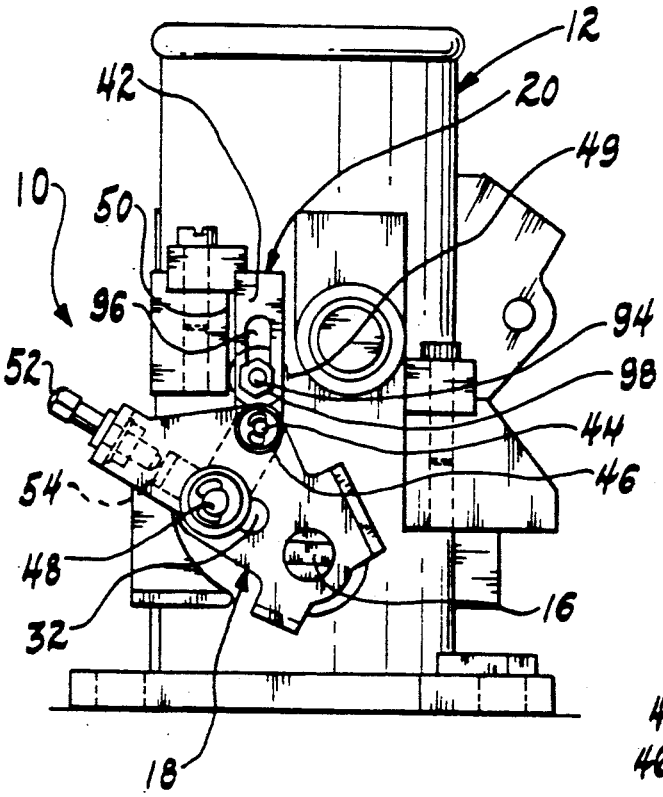
FIG. 14 is a side view of an alternative embodiment of the throttle linkage.
Figure 15:
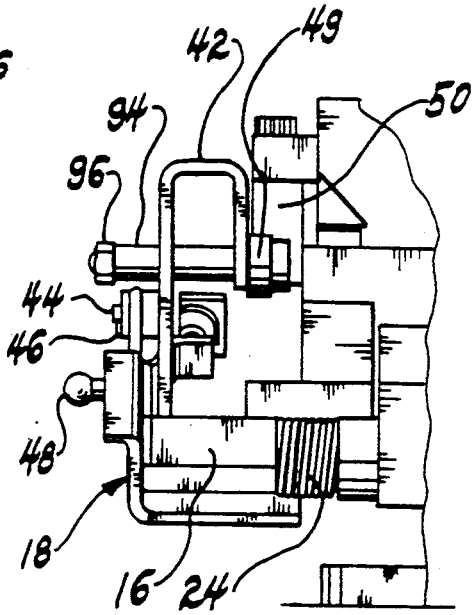
FIG. 15 is a back view of the alternative embodiment shown in FIG. 14.

FIGS. 14 and 15 show an alternative embodiment of the throttle linkage 10 having the roller 49 adjustably affixed adjacent the secondary lever second end 42. The roller 49 is rotatably received on a bolt shank 94 which extends through a slot 96 in the secondary lever second end 42, and is secured thereto by a nut 98. Because the roller 49 can be secured at any location within the slot 96, it can be adjusted to abut the stop 50 at various radial distances from the pivot pin 44. This enables the effective length of the lever arm between the roller 49 and the pivot pin 44, and the corresponding lever ratio, to be varied to achieve the desired linkage performance. In order to increase the sensitivity of the linkage 10, for example, the roller 49 can be loosened and resecured at a point within the slot 96 further away from the pivot pin 44.

Figure 16:
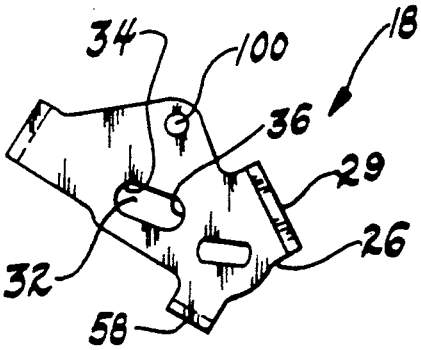
FIG. 16 is a side view of a primary lever for use with the alternative embodiment shown in FIG. 14.
Figure 17:
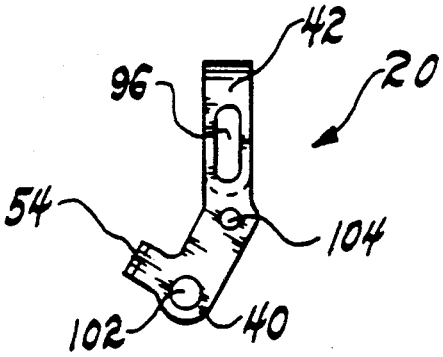
FIG. 17 is a side view of a secondary lever for use with the alternative embodiment shown in FIG. 14.
Figure 18:
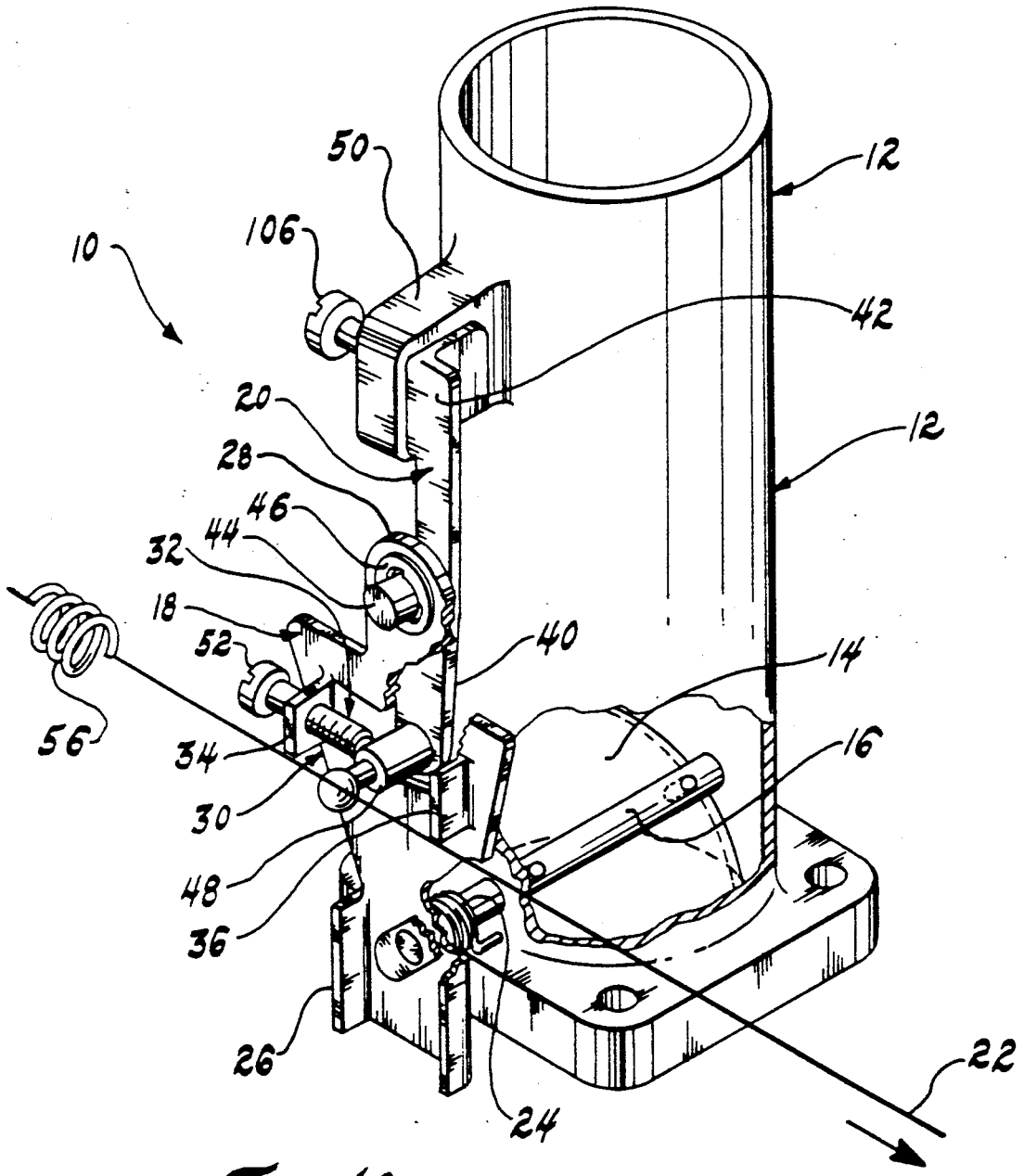
FIG. 18 is a perspective view of another alternative embodiment of the throttle linkage.

FIGS. 16 and 17 show the primary and secondary levers, respectively, for use with the alternative embodiment shown in FIGS. 14 and 15. A hole 100 formed in the primary lever 18 is adapted to receive the pivot pin 44. In the secondary lever 20, the projection 54 is adapted to abut the idle speed screw 52, and a hole 102 receives the cable attachment pin 48. A smaller diameter hole 104 between the hole 102 and the slot 96 receives the pivot pin 44 therethrough so that it is in alignment with the hole 100 of the primary lever 18.

Figure 21:
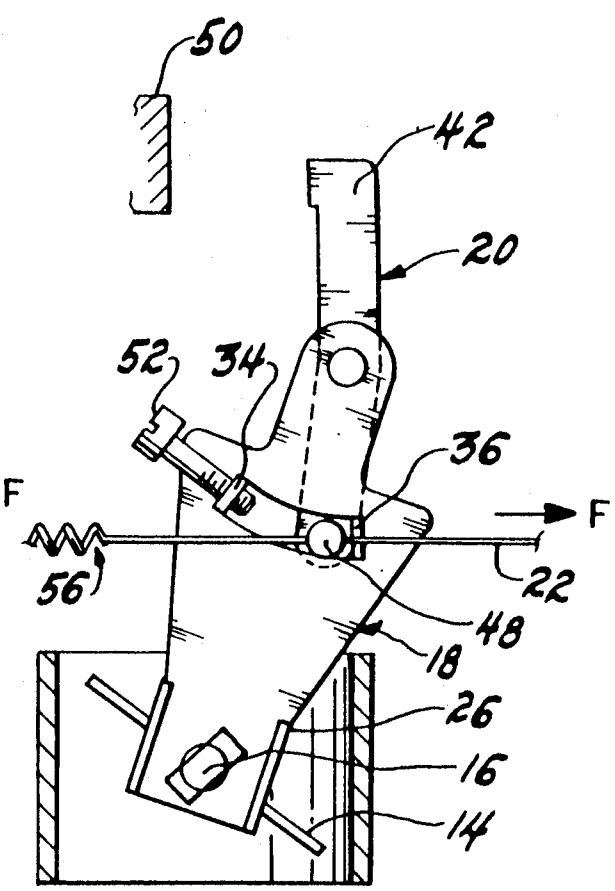
FIG. 21 is a side view of the alternative embodiment shown in FIG. 18 in a high speed throttle position.
Figure 20:
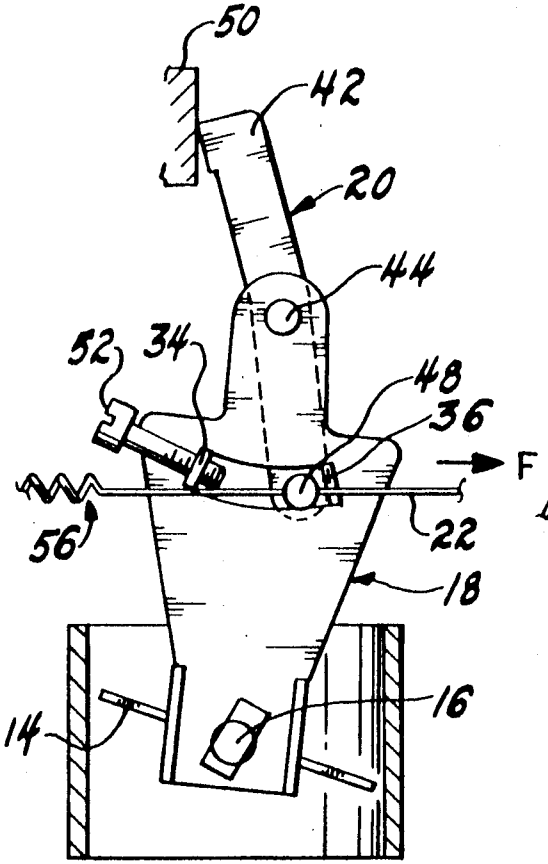
FIG. 20 is a side view of the alternative embodiment shown in FIG. 18 in a low speed throttle position.
Figure 19:
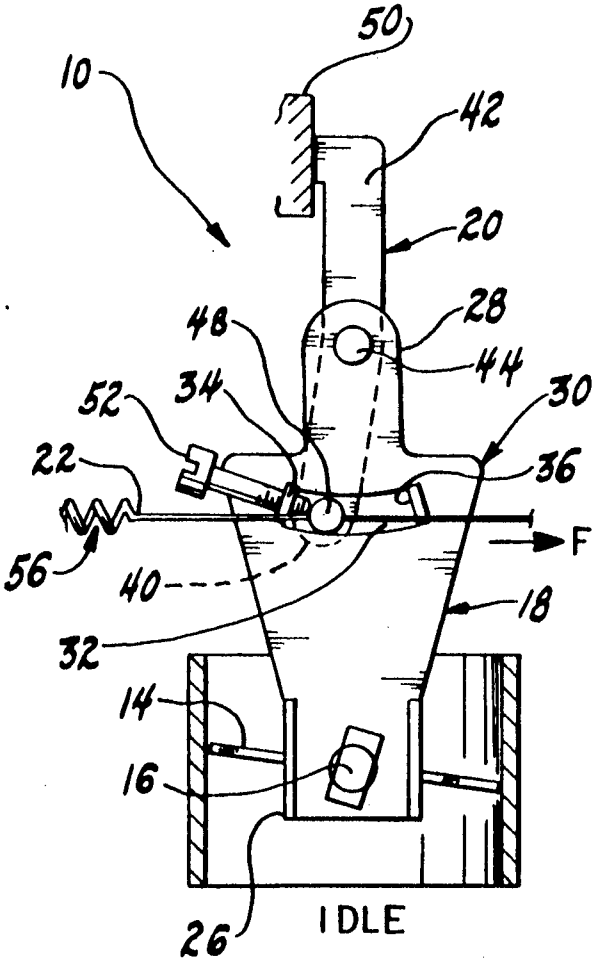
FIG. 19 is a side view of the alternative embodiment shown in FIG. 18 in an idle position.

FIGS. 18-21 show another alternative embodiment of the throttle linkage 10. In this embodiment, the arcuate slot 32 has flanged ends 34 and 36. The idle adjust screw 52 fits through the flanged end 34 to abut the cable attachment pin 48. The stop 50 is provided with a second idle speed screw 106 which provides an adjustable stop for the secondary lever second end 42, which has no roller bearing. This embodiment functions in essentially the same manner as the other embodiments described above. As shown in FIGS. 19-21, the cable attachment pin 48 is initially drawn through the slot 32, slowly rotating the levers 18 and 20 and thus the throttle valve 14. When the pin 48 engages the end 36, the primary lever 18 opens the throttle valve 14 relatively faster.

It should be understood that while the forms of the invention herein shown and described constitute preferred embodiments of the invention, they are not intended to illustrate all possible forms thereof. It also should be understood that the words used are words of description rather than limitation, and various changes may be made without departing from the spirit and scope of the invention disclosed.

I claim:

1. A variable ratio linkage for a throttle valve having a rotary shaft actuated by an accelerator pedal, the linkage comprising:

a primary lever having a fixed end for attachment to a throttle shaft, a free-end radially spaced therefrom, and a central region;

a secondary lever having first and second ends and a pivot therebetween attached to the primary lever and rotatable about a pivot axis, the secondary lever first end cooperating with the primary lever to provide first and second limits for restricting the relative rotation therebetween, the secondary lever second end adapted to abut a stop for limiting the movement thereof;

connection means for connecting the secondary lever first end to the accelerator pedal; and spring means for elastically biasing the throttle shaft to a closed position where the secondary lever first end engages the first limit and the secondary lever second end abuts the stop, wherein movement of the secondary lever first end away from the first limit causes the primary and secondary levers to rotate relative to one another and slowly rotate the throttle shaft until the secondary lever first end engages the second limit, whereupon further movement of the secondary lever first end away from the first limit causes the throttle shaft to rotate at a relatively faster rate.

2. The linkage of claim 1 wherein the first limit for restricting the relative rotation between the primary and secondary levers further comprises an adjustable idle stop cooperating with the secondary lever first end and primary lever central region to enable the throttle shaft closed position to be varied.

3. The linkage of claim 2 wherein the adjustable idle stop comprises an idle speed screw threadingly engaged with the primary lever.

4. The linkage of claim 1 wherein the first limit for restricting the relative rotation between the primary and secondary levers further comprises an adjustable idle stop cooperating with the secondary lever second end to enable the throttle shaft closed position to be varied.

5. The linkage of claim 1 wherein the primary lever has an accurate slot formed in the central region thereof including first and second ends which cooperate with the secondary lever first end to provide the first and second limits.

6. The linkage of claim 5 further comprising a throttle cable attachment pin connected to the secondary lever first end and projecting into the arcuate slot.

7. The linkage of claim 6 wherein the connection means comprises a cable connecting the cable attachment pin to the accelerator pedal.

8. The linkage of claim 1 wherein the pivot axis is fixed relative to the primary and secondary levers.

9. The linkage of claim 1 wherein the pivot axis is generally parallel to the throttle shaft.

10. The linkage of claim 1 further comprising a roller affixed adjacent the secondary lever second end for abutting the stop.

11. The linkage of claim 10 wherein the roller is adapted to be affixed to the secondary lever at various radial distances from the pivot to enable the effective length of the lever arm between the roller and the pivot to be varied to achieve the desired linkage performance.

12. The linkage of claim 1 wherein the spring means for elastically biasing the throttle shaft to the closed position comprises a torsional coil spring wound around the throttle shaft.

13. The linkage of claim 12 wherein the spring engages the primary lever.

14. A variable ratio linkage for a throttle valve having a rotary shaft, the linkage comprising:

a primary lever having a fixed end for attachment to a throttle shaft, a free-end radially spaced therefrom, and a central region;

a secondary lever having first and second ends, a pivot therebetween, a slot located between the second end and the pivot, and a roller moveable within the slot and selectively securable to the secondary lever, the secondary lever being attached to the primary lever and rotatable about a pivot axis generally parallel to the throttle shaft, the secondary lever first end cooperating with the primary level to provide first and second limits for restricting the relative rotation therebetween, the secondary lever second end adapted to abut a stop for limiting the movement thereof; and spring means for elastically biasing the throttle shaft to a closed position where the secondary lever first end engages the first limit and the roller abuts the stop, wherein movement of the secondary lever first end away from the first limit causes the primary and secondary levers to rotate relative to one another and slowly rotate the throttle shaft until the secondary lever first end engages the second limit, whereupon further movement of the secondary lever first end away from the first limit causes the throttle shaft to rotate at a relatively faster rate.

* * * * *